US005615846A

United States Patent [19]

Shmoldas et al.

[11] Patent Number: 5,615,846

[45] Date of Patent: Apr. 1, 1997

[54] EXTENDABLE WING FOR GUIDED MISSLES AND MUNITIONS

[75] Inventors: John D. Shmoldas, Thousand Oaks; Michael B. Hutchings, Westlake Village; Christopher W. Barlow, Newbury Park, all of Calif.

[73] Assignee: GEC Marconi Dynamics Inc., Westlake Village, Calif.

[21] Appl. No.: 334,423

[22] Filed: Nov. 4, 1994

[51] Int. Cl.[6] ..... F42B 10/32

[52] U.S. Cl. ..... 244/3.28; 244/3.26; 244/49

[58] Field of Search ..... 244/3.24, 3.25, 244/3.26, 3.27, 3.28, 3.29, 3.3, 49; 102/293, 384; 89/1.53

[56] References Cited

U.S. PATENT DOCUMENTS

| | | | |
|---|---|---|---|
| 25,080 | 8/1859 | Goodspeed | 244/3.24 |
| 3,942,747 | 3/1976 | Wolkovitch | 244/13 |
| 4,209,147 | 6/1980 | Jones, Jr. | 244/328 |
| 4,447,025 | 5/1984 | Bock et al. | 244/3.28 |
| 4,664,338 | 5/1987 | Steuer et al. | 244/49 |
| 4,699,334 | 10/1987 | Boeder | 244/3.29 |
| 4,858,851 | 8/1989 | Mancini et al. | 244/3.28 |
| 4,923,143 | 5/1990 | Steuer | 244/3.28 |
| 4,998,689 | 3/1991 | Woodcock | 244/49 |
| 5,029,773 | 7/1991 | Lecat | 244/3.28 |
| 5,078,339 | 1/1992 | Lapidot | 244/3.24 |
| 5,141,175 | 8/1992 | Harris | 244/3.25 |
| 5,192,037 | 3/1993 | Moorefield | 244/3.28 |

*Primary Examiner*—Michael J. Carone
*Assistant Examiner*—Theresa M. Wesson

[57] ABSTRACT

A deployable diamond shaped wing for use in extending range or increasing maneuverability of guided missiles or munitions. A hardback (10) mechanism attaches the wing kit to an existing guided munition or missile (12) and the forward wing (24) is attached with a forward wing pivot (44) assembly so as to allow the forward wing (24) to rotate in the horizontal plane. The rear wing (22) is attached to a driveshaft (28) and carriage (26) with a rear wing pivot (48) that allows rear wing (22) rotation in the horizontal plane. The forward wing (24) and rear wing (22) are joined at the wingtips with a wing tip pivot pin (42) and folded laterally along the hardback (10) for storage. A motor (40) is mounted within the hardback (10) and connected to the driveshafts (28) in a manner to cause the carriages (26) to move fore and aft. After launch, the lifting surfaces are extended by powering the driveshaft (28) to move the carriages (26) longitudinally aft with the attached said rear wing pivot (48) and to cause the wings (22 and 24) to form a diamond shaped lifting surface. The wings (22 and 24) can be retracted by reversing the procedure. The entire wing kit assembly is attached to an inventory weapon and launch platform by using the existing suspension points with new hardback lugs (16).

7 Claims, 4 Drawing Sheets

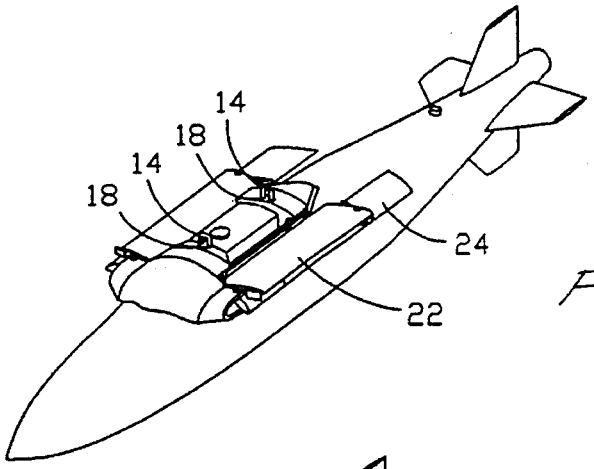
FIG 1A
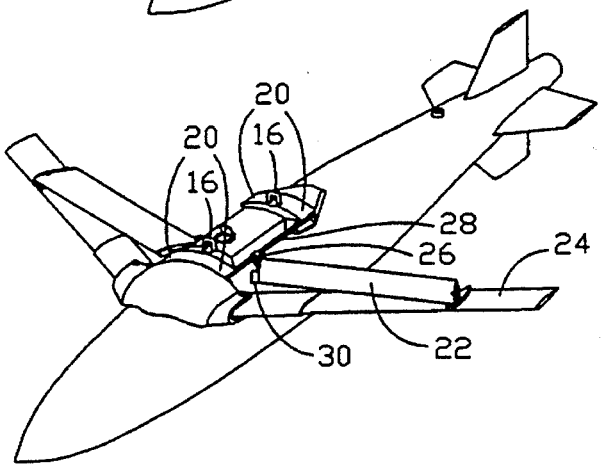
FIG 1B
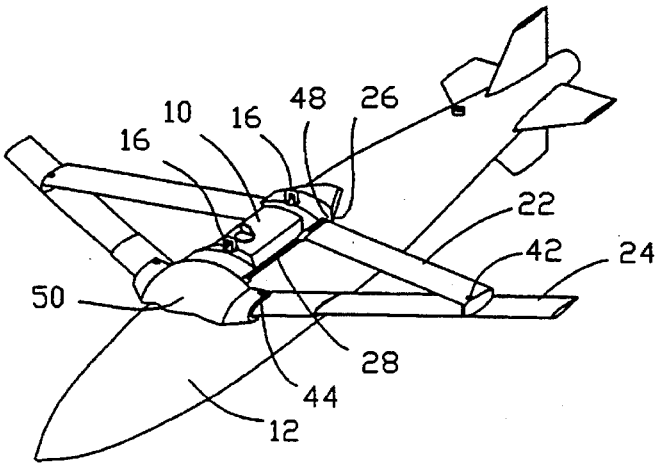
FIG 1C
Fig 1

EXTENDABLE WING FOR GUIDED MISSLES AND MUNITIONS

BACKGROUND

Field of Invention

The present invention relates to the extendible wings and the power deployment mechanism of said wings for a guided projectile, or a guided airborne body such as a bomb, dispenser, munition or missile, whereby for carriage or dense packing considerations the wings are folded but for flight the wings are extended by the action of a power element.

BACKGROUND

Description of Prior Art

In previous art, several attempts have been made to add airfoil surfaces to munitions or missiles to provide control and extended range capability. Prior art generally include multiple pop out flight surfaces, an extendible pair of wings or in the present case of joined wings, they are generally comprised of front and rear spars with flexible coverings to join the spars forming a single aerodynamic surface. Joined wings for aircraft have been patented that provide flexible and foldable surfaces with a control mechanism. In the before mentioned joined wing concepts, the root attachment points are stationary hinge points and strength is achieved through joining the wings and elevating the root of the rear wing providing compression of the upper (rear) wing under load. All these designs were either fragile, produced insufficient lift for heavy weapons, expensive if they contained control mechanisms or could not be extended into a flight configuration after launch from an aircraft or ground launch mechanism such as a tube. In U.S. Pat. No. 3,942,747, Wolkovick discusses the advantages of using a joined wing configuration for lightweight aircraft configurations. The extension mechanisms were manual and unpowered and the design was intended to provide torsional stiffness by offsetting the root attachments in the vertical plane as previously discussed. The flexible airfoil surfaces also provided a means for control through cables that would warp the wings to control lift, pitch and bank angle for a manned aircraft. This design required that the joined wing tips be manually fastened together at the tips after extension from the storage configuration, an unacceptable process after launch from an aircraft or out of a tube. In U.S. Pat. No. 4,923,143, Projectile Having Extendible Wings, Steuer describes a folding front and rear spar which would use a fabric covering to form a single wing. The power element is attached to a slider which pushes against both spars to effect extension. In U.S. Pat. No. 4,858,851, Folding Wing Structure for Missile, Mancini describes a spring deployed telescoping set of fabric covered spars that would again form a single lifting surface. In both the preceding patents, the wing is fragile, inefficient, and unable to achieve high lift over drag ratios. In U.S. Pat. No. 5,141,175, Air Launched Munition Range Extension System and Method, Harris describes a spring powered extendible scissor wing using downwash control to control pitch and bank angle. The Harris scissor wing has a large structure to accommodate in the folded position and the control element is expensive and unnecessarily redundant to munitions and missiles that already have guidance and control mechanisms.

OBJECTS AND ADVANTAGES

The objects and advantages of this invention is that it derives lift from a diamond planform where the rear wing acts in conjunction with the power source to extend after launch, an aerodynamically balanced, high lift to drag ratio front and rear wing joined close to the wingtips to form a diamond configuration without an integrated guidance and control system. This system provides a compact low cost range extension kit compatible with a large inventory of guided munitions and missiles. The folded wings and deployment mechanism are contained in a small cross sectional and longitudinal area providing minimum interference with host aircraft structure and low aerodynamic drag for carriage on a large variety of aircraft and weapon stations. Extension of the wing is accomplished by powering the rear wing root to the rear causing the joined wings to rotate to the extended position. The high efficiency and strength of the deployed wings provide long range and weapon maneuverability. The simplicity of the kit using existing and standard suspension points provide for low cost installation and cost of ownership. Other objects and advantages of the invention will appear from the following description taken in conjunction with the accompanying drawings.

BRIEF DESCRIPTION OF THE DRAWINGS

FIG. 1*a* is an isometric view of the extendible wing kit in the folded position.

FIG. 1*b* is an isometric view of the extendible wing at approximately the mid point during extension.

FIG. 1*c* is an isometric view of the extendible wing kit fully deployed.

Figure 2:
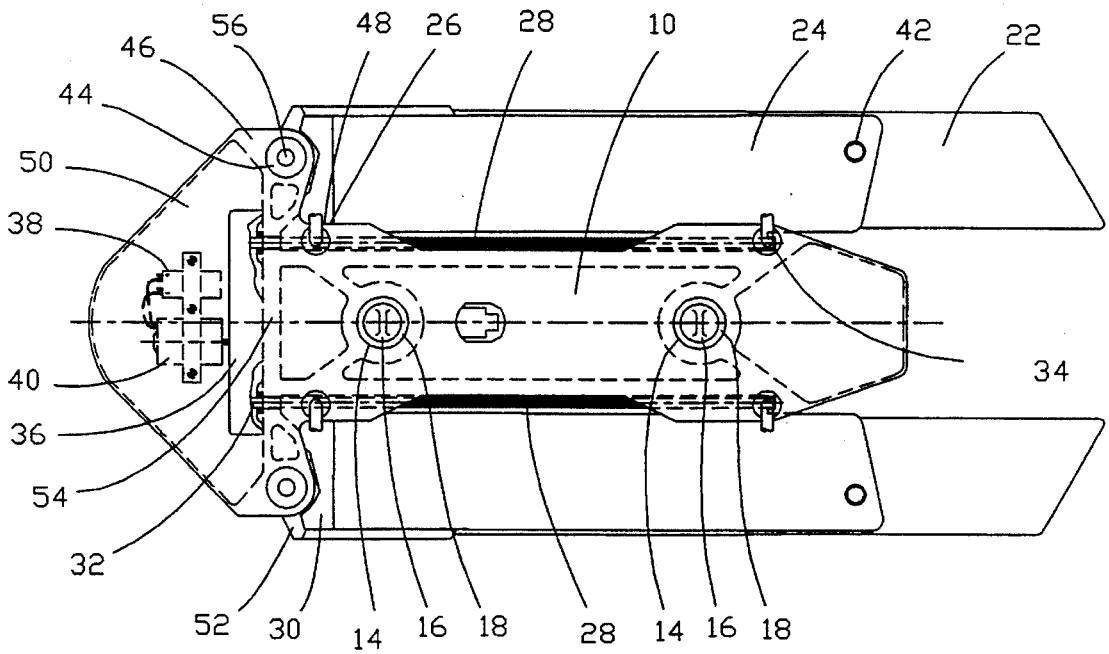
FIG. 2 is a plan view of the strong back assembly, deployment mechanism and folded wing.

4*a* shows the front wing, hardback hinge point cross section.

4*b* shows the driveshaft, aft wing and attachment point cross section.

SUMMARY

An extendible wing kit comprising: a hardback assembly and front and rear wings joined near the tips to form a diamond shape connected to the hardback assembly, an extension and retraction system consisting of motor and carriage assembly that moves the attachment points of the rear wing as a means to cause extension or retraction of said wings, and a means of attachment of the hardback mechanism to a munition by use of existing suspension points, the use of the previously described wing assembly on guided munitions or cruise missiles to provide increased range and maneuverability.

PREFERRED EMBODIMENT

Description

The intention of the present invention was to provide an extendible wing kit that could be easily attached to an existing guided munition or missile and result in an improvement to the range performance and maneuverability of said munition or missile to a degree where weapons could be effectively employed over a larger area and aircraft exposure to point defenses could be significantly reduced.

While the present invention is susceptible to various modifications and alternative constructions, illustrative embodiments are shown in the drawings and will herein be discussed in detail. It should be understood however that it is not the intention to limit the invention to the particular forms disclosed; but on the contrary is to cover all modifications, equivalencies and alternative constructions falling within the spirit and scope of the invention as expressed in the claims.

The design is intended to ensure that launch platform performance is not degraded by excessive installed drag or space requirements and that the extendible wing kit is easily applied to numerous munitions in inventory and development as well as a wide spectrum of launch platforms including both internal and external carriage aircraft and surface launch from rails or tubes.

As best seen in FIG. 1, the invention is comprised of a streamlined hardback 10 which bolts to the guided missile or munition 12 by way of the standard munition lug wells 14, these generally being but not limited to, either 14 inch or 30 inch spacing depending upon the weight class of the said munition 12. The said hardback 10 includes an additional set of hardback lugs 16 and hardback lug pockets 18, mounted above the said existing munition lug wells 14 for attachment to said munition 12 and the parent aircraft. Four swaybrace pads 20 are machined on the said hardback 10 adjacent to said hardback lugs 16 to react to the release unit swaybrace loads. The said hardback 10 design is such that the additional height of the final lug position above the said munition 12 upper surface is minimum.

In the folded position (FIG. 1*a*), the rear wing 22 lies on top of the forward wing 24 and stows closely to the side of the said hardback at about the same vertical level as the upper surface of said munition 12 and with a movable carriage 26 supporting the rear wing 22 at the most forward position of travel. To deploy the joined said wings, 22 and 24, the said carriages 26 are moved aft on and by the action of a pair of driveshafts 28. The rearward movement of said carriages 26, each attached to a rear wing root casting 30, and the relative geometry of the joined wing surfaces, forces the said forward wing 24 to pivot out forming a triangular (diamond) planform, (FIG. 1*b*). The deployment is complete when the said rear wing 22 passes 90 degrees of rotation. With less than 90 degrees of rotation the said wings, 22 and 24, rely upon the said driveshafts 28 to maintain deployment, above 90 degrees the planform locks into position (FIG. 1*c*), under the action of the overall drag force, and requires a positive action to restow the wings.

The compactness of the design reduces the undeployed physical envelope, and limits installed drag increments. During the initial stages of deployment the said forward wing 24 moves rapidly outboard as the roots of rear wings 22 are driven aft by the carriage 26 movement. At this point, the drag loads are low and assist the motion of the rear wing 22. As the rear wings 22 are driven further the geometry slows the rate of deployment of the forward wings 24. As the wings, 22 and 24, become fully deployed, the increased mechanical advantage of the driveshafts 28 offsets the increase in drag force. Thus, full deployment is realized with the most favorable geometry. This design offers a balanced deployment mechanism that considerably reduces the risk associated with traditional systems. The symmetry and deployment scheme of the planform retains the center of pressure from the wing lift aft of the center of gravity at all times to ensure that the vehicle remains stable during wing extension and freeflight. Wing retraction is achieved by reversing the process.

Referring to plan view of the folded wing kit shown in FIG. 2, the said hardback 10 is shaped to provide a forward driveshaft support 32 and a rear driveshaft support 34 for the two said driveshafts 28 mounted on each side. These are driven by gear trains 36 from a centrally mounted power source 38 and a motor 40 to ensure symmetrical operation and deployment of the said forward wing 24 and said rear wing 22 surfaces.

The final deployed diamond wing planform is achieved with two wing surfaces linked with a wing tip pivot pin 42. The said forward wing 24, forming the leading edge of the planform, rotates on a hardback forward wing pivot 44 between machined ears 46 on the front section of the hardback, the said hardback forward wing pivot 44 being supported by roller bearings in each said machined ear 46. The rear wing 22 pivots freely about the forward wing 24, attached to said forward wing 24 by said wing tip pivot pin 42 at about 75% of span, and is supported at the inboard end by said rear wing root casting 30 attached through a rear wing pivot 48 attached to said carriage 26 running on said driveshaft 28.

As with most deployable wing systems, one of the major design drivers is the reaction of the root bending moment from the wing lift, without a continuous main spar. With the present design, the said forward wing 24 is mounted to a forward wing root structure 52, which pivots on a wide thrust bearing 56 attached to the main cross beam 54. The assembly is streamlined by a hardback cover 50. This combined structure provides a satisfactory load path to limit the induced stresses. The said forward wing pivot 44 and said wing tip pivot pin 42 provides mutual stabilization and torsional stiffness for both said wings, 22 and 24, any wing twist being reacted by bending in the other wing. This design allows a simple, easily produced extrusion without the complexity of one or more internal shear webs.

The diamond wing design provides a number of important aerodynamic characteristics. The wing offers light weight and high torsional stiffness coupled with a high trimmed maximum lift coeficient and benign stall characteristics. The combination of swept forward and swept aft wings joined towards the outer edge induces an energetic inward flow along the upper surface of the said rear wings 22 which will scour the tip region, re-energize the boundary layer, and delay the typical tip stall. Separation will spread slowly from the root producing a smooth flat topped lift curve with an increase in the linear range of $C_L$ (lift coefficient) and a higher $C_{L\ MAX}$ (maximum lift coefficient).

Each airfoil of the wing must be designed to operate in the curved flowfield generated by lift on the adjacent airfoil. Of necessity this implies differences between said forward wing 24 and said rear wing 22 sections.

PREFERRED EMBODIMENT

Operation

The description of the preferred embodiment is provided to enable any person skilled in the art to make or use the present invention. Various modifications of the embodiment will be readily apparent to those skilled in the art, and the generic principles defined herein may be applied to other embodiments without the use of inventive faculty. Thus the present invention is not intended to be limited to the embodiments shown herein but to be accorded the widest scope consistent with the principles and features disclosed herein.

FIG. 1 shows a typical munition in three views with the present invention hardback lugs 16 mounted to the original munitions lug 14 sockets. The folding wing structure is illustrated in a fully folded position (FIG. 1*a*) with the wing panels on either side of the hardback 10 with the rear wing 22 laying on top of the forward wing 24. The existing munition lug (14) positions as fitted with new hardback lugs 16, with the adjacent swaybrace pads 20, can be seen from the top of the said hardback 10.

This represents the carriage configuration where the munition 12 and wing kit would be attached by the said new hardback lugs 16 to the ejector release unit (not shown) mounted in a pylon of the carrier aircraft. After release of the said munition 12 from the aircraft, the folded configuration would be maintained for a period of time calculated to ensure safe clearance of the munition from the vicinity of the launch platform. After this delay measured by a simple onboard timer (not shown) power would be applied to the deployment mechanism and the said carriages 26 would start to move aft on the driveshafts 28 as in FIG. 1*b*. Because of the relative spans of the two wing components the geometry forces the forward wing 24 to rotate outwards and the rear wing 22 follows as shown. FIG. 1*c* shows the deployment complete with the said carriages 26 moved to the furthest aft position, the said forward wing 24 fully deployed in a swept position, and the connected said rear wing 22 rotated by more than 90 degrees to ensure positive location in a diamond configuration.

The design is such that the aerodynamic center is well aft in the folded configuration to provide a stable carriage and launch vehicle. As the deployment progresses, the aerodynamic center moves forward until the said rear wing 22 reaches approximately 90 degrees of rotation (FIG. 1*b*). As the rotation continues the sweep angle of the said forward wing 24 starts to reduce and the aerodynamic center begins to move aft. The geometry is designed to provide the optimum static margin of the combined guided munition or missile 12 and fully deployed wing kit without entering any unstable configurations during the deployment process, thus remaining within the control authority of the munition guidance system.

Figure 3:
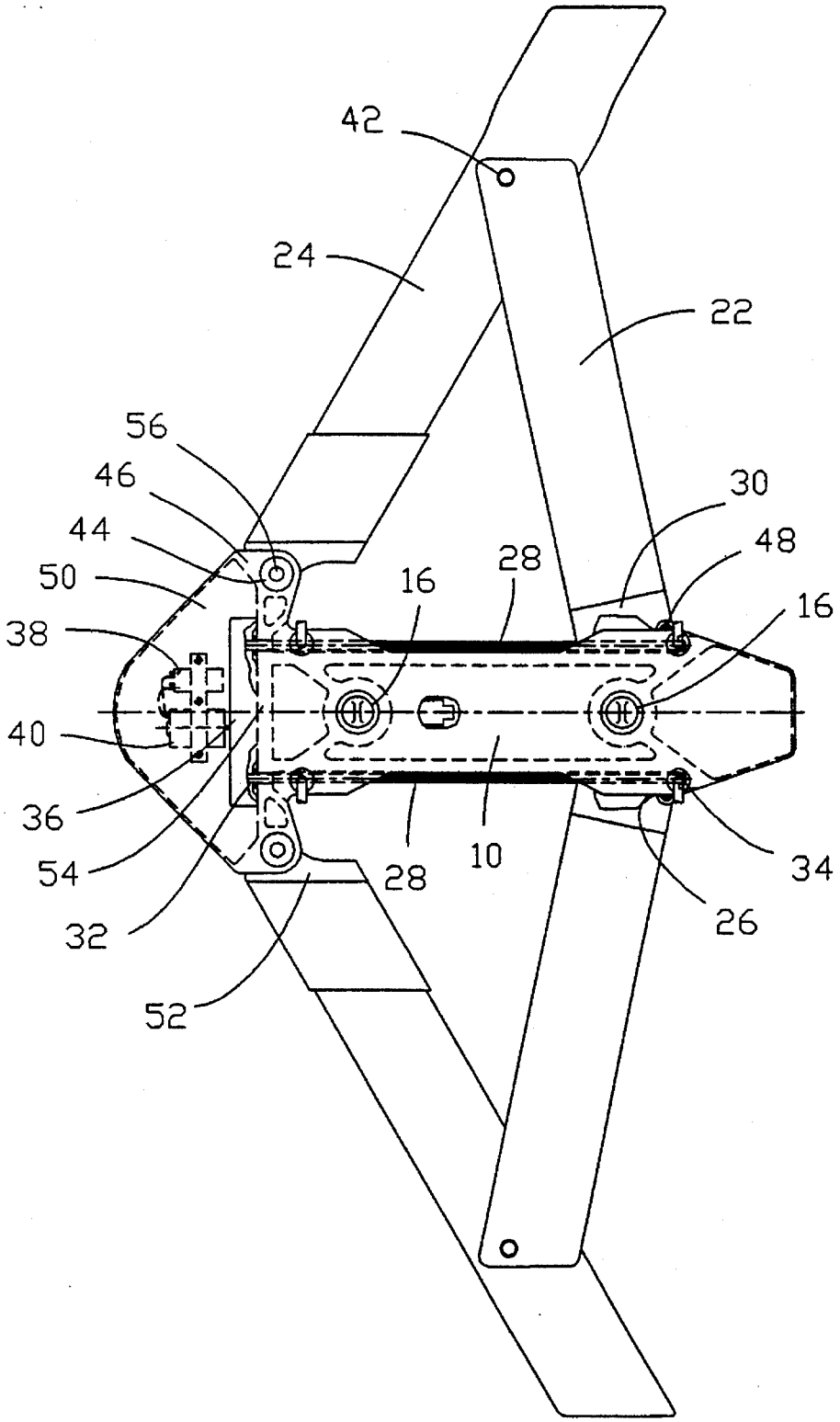
FIG. 3 is a plan view of the strong back assembly, deployment mechanism, and deployed wing.

FIGS. 2 and 3 show a more detailed view of the wing kit. The said forward wing 24 section comprises a said hardback forward wing pivot 44, shaped to fit between the said two machined ears 46 on the hardback. Both top and bottom said machined ears 46 are shaped to accept the pair of said thrust bearings 56 which allows the said forward wing 24 to rotate in the horizontal plane located by the said forward wing pivot 44. Attached outboard of the said hardback 10 is said forward wing 24.

The said rear wing 22 section similarly comprises a rear wing root casting 30 which attaches to said rear wing pivot 48 mounted on said carriage 26 attached to said driveshafts 28. The rear wing pivot 48 is located to the rear to ensure that said rear wing 22 rotation during extension can proceed freely. The said rear wing 22 is attached to the root casting in a similar manner to the said forward wing 24. The end plate of the rear wing is machined to accept a rear wing pivot 48 which joins each pair of forward wings 24 and rear wings 22 outboard of the midpoint of said forward wing 24.

The said hardback 10 comprises a casting streamlined at the front end to minimize the increased drag. This streamlined structure is hollow and contains said power source 38 and said motor 40 connected by said gear trains 36 to the said driveshafts 28 mounted on each side of said hardback 10. Behind the said hardback front 50 streamlined structure, said main cross beam 54 supports the said machined ears 46 which hold the said thrust bearings 56 and hardback forward wing pivots 44 and forms the main load path to react the said forward wing 24 root bending moment. This said main cross beam 54 also provides the forward support for the driveshafts 26. Behind, and attached to, the said main cross beam 54 is the said hardback 10 casting formed around the munition upper surface and containing internal structure at the said hardback lug pockets 18 to attach the guided munition or missile 12, to the hardback 10, by means of the hardback lugs 16, to the carrier aircraft. Aft of the rear hardback lug pockets 18, the said hardback 10 terminates with a tapering streamlined closure which also acts as a rear support for the said driveshafts 28.

Figure 4A:
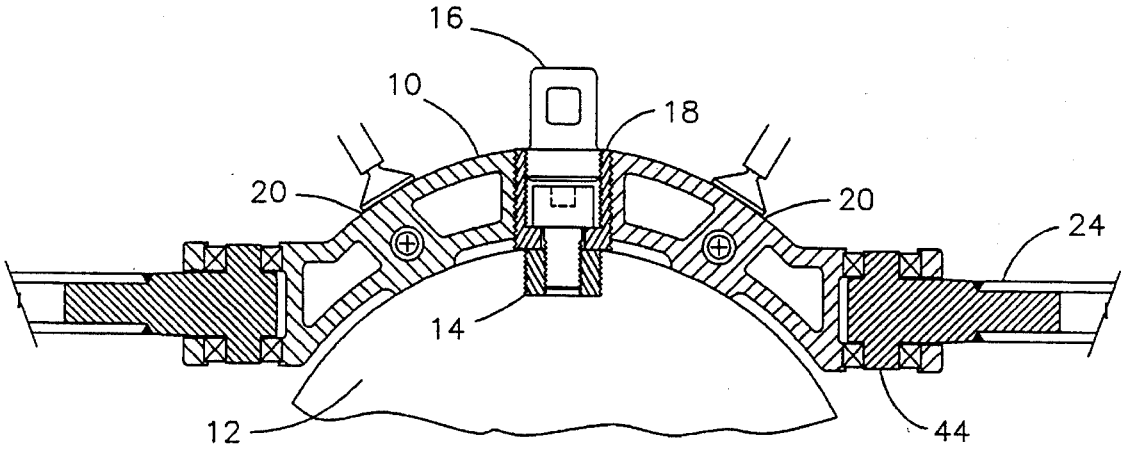
FIG. 4 shows two front cross sectional views of the extendible wing assembly.
Figure 4B:
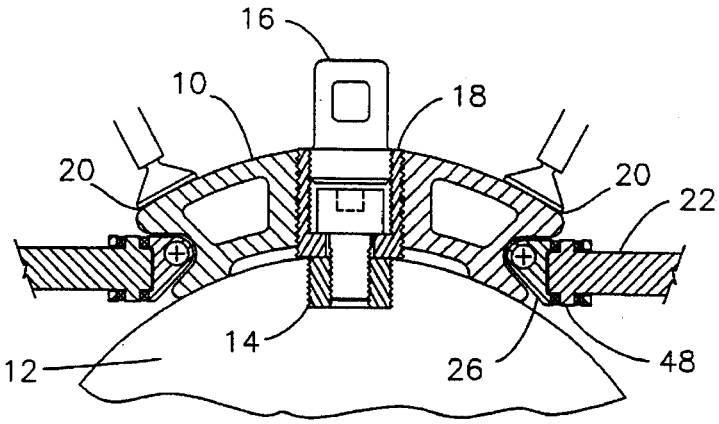

FIG. 4 shows more details of the wing attachment at both the front (FIG. 4*a*) and rear (FIG. 4*b*) attachment stations and the said hardback 10 cross section with the internal structure necessary for attachment with the hardback lugs 16 and the reaction of the swaybrace pads 20.

The position of the said forward wing 24 attachment points is a compromise between ensuring a compact stowed configuration of the said forward wing 24 and said rear wing 22 sections with minimal lateral extension beyond the munition body diameter and minimizing the installed height of the hardback 10 above the guided munition or missile 12 top surface. The current design only extends a minor amount above the original lug position reducing drag and interference with the carriage aircraft and other stores compared with other art.

CONCLUSIONS, RAMIFICATIONS, AND SCOPE

Accordingly it can be seen that the invention provides a significant increase in cost effectiveness for inventory and developmental weapons by providing a significant increase in range and maneuverability by the addition of a simple wing kit that utilizes existing standard weapon suspension points and installed munition or missile guidance and control systems. The kit can be used on inertially aided free fall weapons, rocket boosted, rocket sustained, turbine powered, propeller driven guided missiles or unmanned vehicles both air or surface launched. The compact profile of the installed retracted diamond wing kit is compatible with the standard stores suspension equipment and space availability with a large number of aircraft for both internal and external carriage. The relatively low cost of the system and ease of installation provide a highly cost effective upgrade to a variety of inventory and developmental guided weapons.

While the above description contains many specificities, these should not be construed as limitations on the scope of the invention. Many other ramifications and variations are possible within the teachings of the invention. For example, the wing mechanism invention can be designed into the structure of a new missile and can be fully or partially extended or retracted to control lift and drag to meet various mission profile requirements including launch, cruise, and terminal engagement. Multiple wings of concept similar to the invention, can be used in both vertical and horizontal planes to provide not only lift but side force. The system can be manufactured in a fixed extended wing position where prelaunch carriage is not constrained to preclude the wing extended configuration and eliminate the pads required for extension. The wing kit can be mounted under the weapon by straps, eliminating the need for lug attachments and swaybrace support. The lugs can be replaced by railguides for boosted rail or tube launch.

Thus the scope of the invention should be determined by the appended claims and their legal equivalents, rather than by the examples given.

What is claimed is:

1. A folding wing kit for a guided munition, comprising:

a. a hardback assembly which is attached to the munition and launch platform by the use of existing lug wells and aircraft weapon suspension equipment, b. a motor mounted within the hardback assembly, c. a carriage assembly attached to the hardback assembly and connected to the motor so as to translate fore and aft when energized, d. a pair of wing assemblies comprising of a forward wing and rear wing joined with a pivot near the wingtips of which the said forward wing is attached with a pivot to the hardback assembly and the said rear wing is attached with a pivot to said carriage assembly such that aft movement of the carriage will cause both wings to extend and forward movement will cause both wings to retract, and e. a means for controllably coupling mechanical energy from the motor to the wings whereby extension and retraction of the joined wings can be performed.

2. The wing kit of claim 1, further including the rear wing is a strut.

3. The wing kit of claim 1, further including motor provides rotational force to two drivescrews, as means to move the carriage assemblies fore and aft which extends and retracts the joined wings.

4. A device for extending the range of a guided munition comprising:

a. a hardback member, b. a pair of wing assemblies comprising of a forward wing and rear wing joined with a pivot near the wingtips of which the said forward wing is attached with a pivot to the hardback assembly and the said rear wing is attached with a pivot to said carriage assembly such that movement of the carriage will cause both wings to extend and opposite movement will cause both wings to retract, attached to the said hardback member, which are joined near the wing tips, c. a means for extending and retracting said wings after launch, and d. a means for attaching such hardback to guided munition and launch platform so that the device can extend the said joined wings after separation from said launch platform to provide a pair of front and rear joined wings to extend the range of said guided munition.

5. The device of claim 4, further including the said hardback being attached under the guided munition with straps.

6. The device of claim 4, further including the said hardback member being an integral part of the structure of a munition.

7. A device for extending the range of a guided munition comprising:

a. a hardback member, b. a pair of wing assemblies comprising of a forward wing and rear wing joined with a pivot near the wingtips of which the said forward wing is attached with a pivot to the hardback assembly and the said rear wing is attached with a pivot to said carriage assembly such that aft movement of the carriage will cause both wings to extend and forward movement will cause the wings to retract, c. a means of attaching said hardback to said guided munition and launch platform, and d. a means of extending the wings before launch to provide a pair of front and rear joined wings to extend the range of said guided munition.

* * * * *